US011835221B2

(12) United States Patent
Hou et al.

(10) Patent No.: US 11,835,221 B2
(45) **Date of Patent: *Dec. 5, 2023**

(54) LIGHTING APPARATUS

(71) Applicant: XIAMEN LEEDARSON LIGHTING CO., LTD, Fujian (CN)

(72) Inventors: Shouqiang Hou, Fujian (CN); Zhiguo Lin, Fujian (CN); Xiaoliang Wen, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/981,245

(22) Filed: Nov. 4, 2022

(65) Prior Publication Data

US 2023/0054299 A1 Feb. 23, 2023

Related U.S. Application Data

(63) Continuation of application No. 17/105,582, filed on Nov. 26, 2020, now Pat. No. 11,519,584.

(30) Foreign Application Priority Data

Nov. 27, 2019 (CN) ..... 201922081714.0

(51) Int. Cl.

| | |
|---|---|
| ***F21V 5/02*** | (2006.01) |
| ***F21V 9/30*** | (2018.01) |
| ***F21V 29/70*** | (2015.01) |
| ***F21V 9/40*** | (2018.01) |
| *F21Y 105/10* | (2016.01) |
| *F21Y 115/10* | (2016.01) |

(52) U.S. Cl.

CPC ..... *F21V 5/02* (2013.01); *F21V 9/30* (2018.02); *F21V 9/40* (2018.02); *F21V 29/70* (2015.01); *F21Y 2105/10* (2016.08); *F21Y 2115/10* (2016.08)

(58) Field of Classification Search

CPC ..... F21V 9/30; F21V 9/40; F21V 5/02; F21V 21/03; F21V 21/04; F21V 29/70

See application file for complete search history.

(56) References Cited

U.S. PATENT DOCUMENTS 3,502,865 A * 3/1970 Matteson ..... F21V 5/02 362/309
7,806,580 B2 * 10/2010 Lin ..... F21K 9/00 362/97.3
11,519,584 B2 * 12/2022 Hou ..... F21V 9/40
(Continued)

*Primary Examiner* — Evan P Dzierzynski
*Assistant Examiner* — Nathaniel J Lee
(74) *Attorney, Agent, or Firm* — Chun-Ming Shih; LANWAY IPR SERVICES

(57) ABSTRACT

A lighting apparatus includes a light source module, a light passing cover, a prism plate and a surface rim. The light source module includes a light source plate and multiple LED modules mounted on the light source plate. The light passing cover has a first side facing to the multiple LED modules for receiving a light from the multiple LED modules. The prism plate is disposed with more than 50 prism units for diffusing the light passing through the light passing cover from a second side of the light passing cover. The surface rim has a light opening for the light diffused by the prism units to escape from the lighting apparatus.

14 Claims, 8 Drawing Sheets

(56) References Cited

U.S. PATENT DOCUMENTS

| | | | | |
|---|---|---|---|---|
| 2006/0164858 | A1* | 7/2006 | Park | G02F 1/133603 362/330 |
| 2008/0316603 | A1* | 12/2008 | Jang | G02B 5/0278 264/2.7 |
| 2011/0176295 | A1* | 7/2011 | Chang | F21V 21/04 362/147 |
| 2011/0255292 | A1* | 10/2011 | Shen | F21V 15/01 362/311.02 |
| 2012/0182733 | A1* | 7/2012 | Cho | F21V 13/00 362/235 |
| 2014/0179037 | A1* | 6/2014 | Lai | H01L 33/507 438/27 |
| 2016/0231498 | A1* | 8/2016 | Wang | G02B 5/045 |
| 2016/0339203 | A1* | 11/2016 | Krames | H05B 45/20 |
| 2017/0351127 | A1* | 12/2017 | Masuda | G02F 1/133615 |
| 2019/0072262 | A1* | 3/2019 | Zeng | F21V 23/009 |

* cited by examiner

LIGHTING APPARATUS

RELATED APPLICATION

This application is a continuation application of U.S. patent application Ser. No. 17/105,582.

FIELD

The present invention is related to a lighting apparatus, and more particularly related to a lighting apparatus with a compact design.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

It is important to find a compact design on light devices. Such light devices need to have low cost, flexible and easy to be assembled.

When light devices are used so frequently everywhere, it is beneficial to find a better design with better technical effects.

SUMMARY

In some embodiments, a lighting apparatus includes a light source module, a light passing cover, a prism plate and a surface rim.

The light source module includes a light source plate and multiple LED modules mounted on the light source plate.

The light passing cover has a first side facing to the multiple LED modules for receiving a light from the multiple LED modules.

The prism plate is disposed with more than 50 prism units for diffusing the light passing through the light passing cover from a second side of the light passing cover.

The surface rim has a light opening for the light diffused by the prism units to escape from the lighting apparatus.

In some embodiments, the surface rim has a side wall for enclosing and placing the prism plate.

In some embodiments, the lighting apparatus may also include a bracket for fixing keeping the multiple LED modules with a predetermined distance to the light passing cover.

In some embodiments, the bracket has a side wall with a first edge fixing to the light source module and with a second edge fixing to the light passing cover.

In some embodiments, the prism plate has a positioning groove for inserting the light passing cover.

In some embodiments, the lighting apparatus may also include a back cover to fix to the side wall of the surface rim.

In some embodiments, the side wall has a pair of protruding arms to be inserted through corresponding plug holes of the back cover.

In some embodiments, each protruding arm is attached with an elastic unit for fixing to an installation platform.

In some embodiments, the light source module is disposed on the back cover.

In some embodiments, the back cover includes metal material for heat dissipation.

In some embodiments, the surface rim includes metal material for heat dissipation.

In some embodiments, the back cover is a circular shape and the surface rim has a rectangular shape.

In some embodiments, the prism units are arranged with a scattered order to scattering lights of the light source module in various directions.

In some embodiments, the prism units in central positions have larger diameters than the prism units in peripheral positions.

In some embodiments, the prism units are arranged on a three-dimension curve convex surface.

In some embodiments, the light passing cover has diffusion lenses corresponding to the LED modules.

In some embodiments, the light passing cover is a flat plastic plate.

In some embodiments, the light passing cover is a glue layer.

In some embodiments, the glue layer contains fluorescent material.

In some embodiments, there is an anti-blue-light layer disposed between the light passing cover and the prism plate layer.

DETAILED DESCRIPTION

Figure 8:
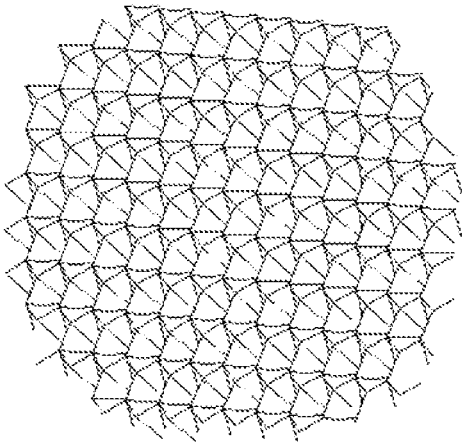
FIG. 8 illustrates a partial zoom-up view of a prism plate example.
Figure 9:
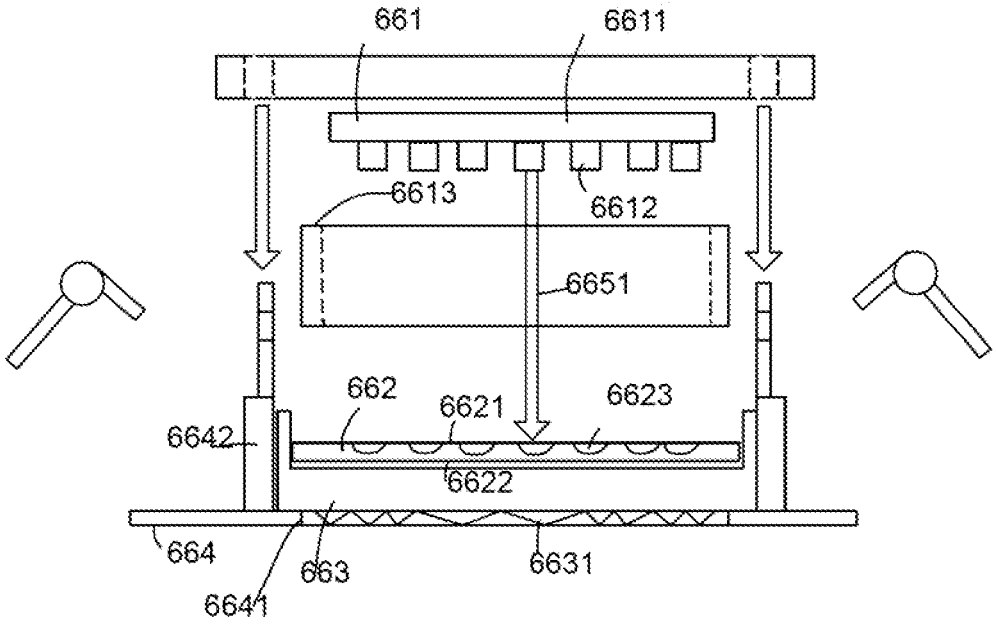
FIG. 9 shows another embodiment.

FIG. 9 shows an exploded view of a lighting apparatus embodiment. In FIG. 8, the lighting apparatus includes a light source module 661, a light passing cover 662, a prism plate 663 and a surface rim 664.

The light source module 661 includes a light source plate 6611 and multiple LED modules 6612 mounted on the light source plate 6611.

The light passing cover 662 has a first side 6621 facing to the multiple LED modules 6612 for receiving a light 6651 from the multiple LED modules 6612.

The prism plate 6621 is disposed with more than 50 prism units 6631 for diffusing the light passing through the light passing cover 662 from a second side 6622 of the light passing cover 662. Specifically, there are multiple polygonal protruding blocks on a surface of the prism plate 661 and each polygonal protruding block is a prism unit. The prism unit has multiple facet with a tilt angle for performing light refraction to achieve the goal of diffusing the light evenly so that human eyes do not see the LED modules directly.

The surface rim 664 has a light opening 6641 for the light diffused by the prism units 6631 to escape from the lighting apparatus.

A detailed example based on the embodiment disclosed above with different views may be found in FIG. 1 to FIG. 8, which are explained as follows.

In some embodiments, the surface rim 664 has a side wall 6652 for enclosing and placing the prism plate 663.

Figure 1:
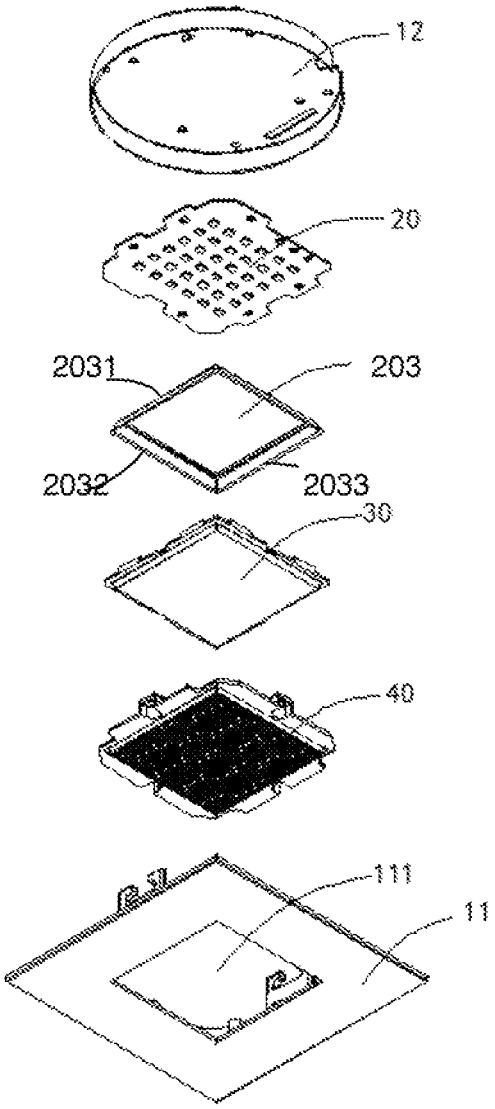
FIG. 1 illustrates a lighting apparatus embodiment.

In some embodiments, the lighting apparatus may also include a bracket 6613 for fixing keeping the multiple LED modules 6612 with a predetermined distance to the light passing cover 662. FIG. 1 shows an example of such concept with an exploded view.

In FIG. 1, there is a surface rim 11 with a light opening 111. A prism plate 40 is installed to fit the light opening 111. There is a light passing cover 30 placed on the prism plate 40. A bracket 203 is placed between the light source module 20 and the light passing cover 30.

A back cover 12 is attached to connect the surface rim 11 to enclose the prism plate 40, the light passing cover 30, the bracket 203 and the light source module 20. The back cover 12 may be made of metal material for carrying heat away from the light source module 20.

In FIG. 1, the bracket 203 has a side wall 2033 with a first edge 2031 fixing to the light source module 20 and with a second edge 2032 fixing to the light passing cover 30.

Figure 7:
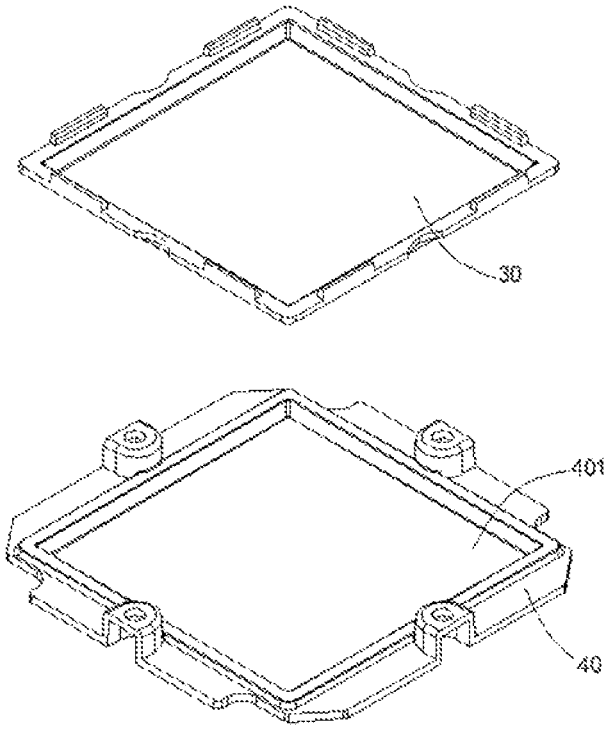
FIG. 7 illustrates components in an embodiment.

Please refer to FIG. 7. In some embodiments like FIG. 7, the prism plate 40 has a positioning groove 401 for inserting the light passing cover 30.

Figure 6:
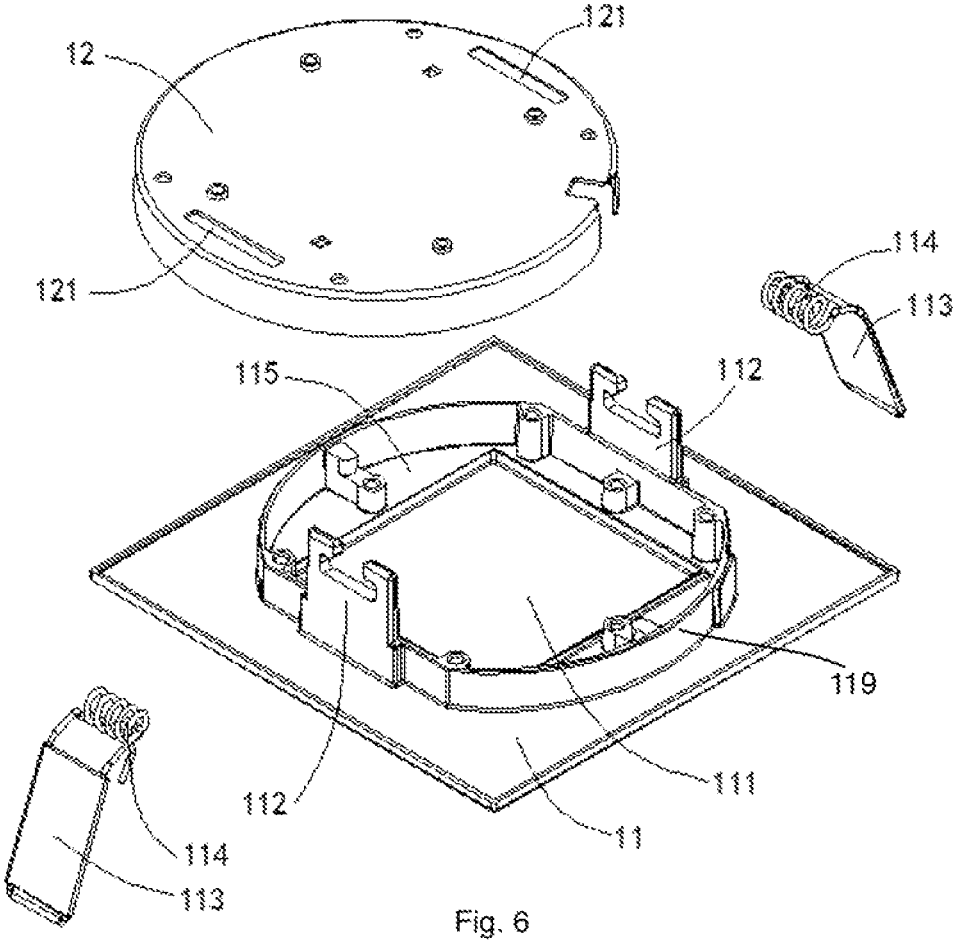
FIG. 6 illustrates components in an embodiment.

Please refer to FIG. 6. In some embodiments like FIG. 6, the lighting apparatus may also include a back cover 12 to fix to the side wall 119 of the surface rim 11.

In some embodiments, the side wall 119 has a pair of protruding arms 112 to be inserted through corresponding plug holes 121 of the back cover 12.

In some embodiments, each protruding arm 121 is attached with an elastic unit 113 for fixing to an installation platform, like an installation cavity on a ceiling. Such elastic unit 113 has a spring 114 as illustrated and may be deformed to insert into the cavity and then uses elastic force to keep the lighting apparatus staying in the cavity.

There is a buckle groove 115 on the surface rim 11 for inserting the prism plate so that the prism units face to the light opening 11.

In some embodiments, the light source module is disposed on the back cover, as illustrated in FIG. 9.

In some embodiments, the back cover includes metal material for heat dissipation. For example, the back cover may be made of metal or metal with plastic wrapping or plastic material with high heat dissipation ratio.

In some embodiments, the surface rim includes metal material for heat dissipation. By engaging the back cover with the surface rim while both are made of metal material, the heat of the light source module is efficiently removed.

In some embodiments, the back cover is a circular shape and the surface rim has a rectangular shape, as the example shown in FIG. 6.

Figure 10:
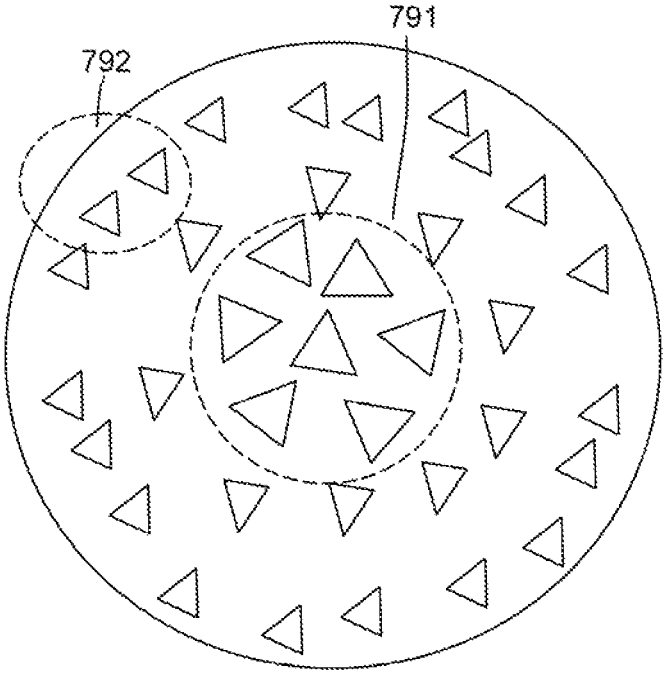
FIG. 10 shows prism unit arrangement on a prism plate.

In FIG. 10, the prism units, illustrated as triangles for showing their directions, are arranged with a scattered order to scattering lights of the light source module in various directions. For example, these triangles direct to different directions. Please be noted these triangles are only for illustrating the concept. In embodiments, these prism units are arranged to direct to different directions, instead of aligning as a simple array.

However, even the prism units are arranged in a simple array, there is still good visual effect, just a random arrangement further improve the diffusion effect.

In some embodiments, the prism units in central positions 791 have larger diameters than the prism units in peripheral positions 792. This is found providing nice diffusion effect.

Figure 11:
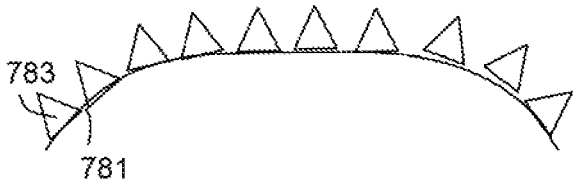
FIG. 11 shows prism units mounted on a convex surface.

In FIG. 11, the prism units 783 are arranged on a three-dimension curve convex surface 781. An optical prism is a transparent optical element with flat, polished surfaces that refract light. At least one surface is angled. The traditional geometrical shape of an optical prism is that of a triangular prism with a triangular base and rectangular sides, and in colloquial use "prism" usually refers to this type. Some types of optical prism are not in fact in the shape of geometric prisms. Prisms can be made from any material that is transparent to the wavelengths for which they are designed. Typical materials include glass, plastic, and fluorite.

In FIG. 9, the light passing cover has diffusion lenses 6623 corresponding to the LED modules 6612.

In some embodiments, the light passing cover is a flat plastic plate. Specifically, there may be diffusion lenses on the light passing cover. In other embodiments, the light passing cover may be completely flat, just to protect the LED modules.

Figure 12:
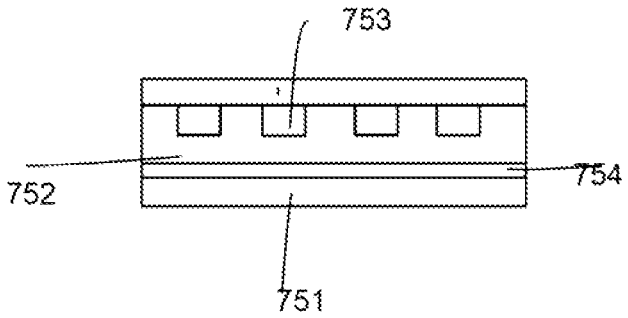
FIG. 12 shows a glue layer used as the light passing cover.

In FIG. 12, the light passing cover 752 is a glue layer. Specifically, gel glue is attached to fill the space between the light source module 753 and the prism plate 751. The gel glue may be hardened using ultra-violet light, as a protective layer between the LED modules and the prism plate.

In some embodiments, the glue layer contains fluorescent material, e.g. to change spectrum of the output light.

In FIG. 12, there is an anti-blue-light layer 754 disposed between the light passing cover 752 and the prism plate layer 751.

Figure 2:
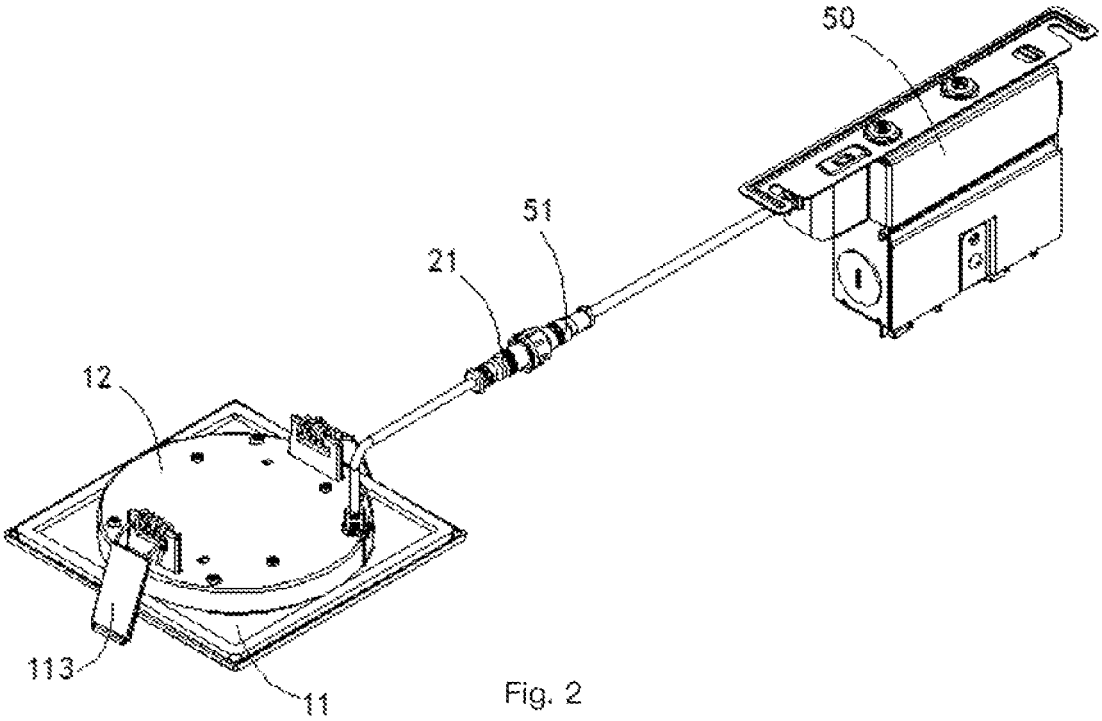
FIG. 2 illustrates the example of FIG. 1 connected to a driver box.

Please refer to FIG. 2. FIG. 2 shows the lighting apparatus has a driver box 50. The driver box 50 has a second connector 51 detachably connected to a first connector 21 that is electrically connected to the light source module. The light source module is enclosed between the back cover 12 and the surface rim 11. There is an elastic unit 113 for fixing the lighting apparatus to a cavity, as mentioned above.

Figure 3:
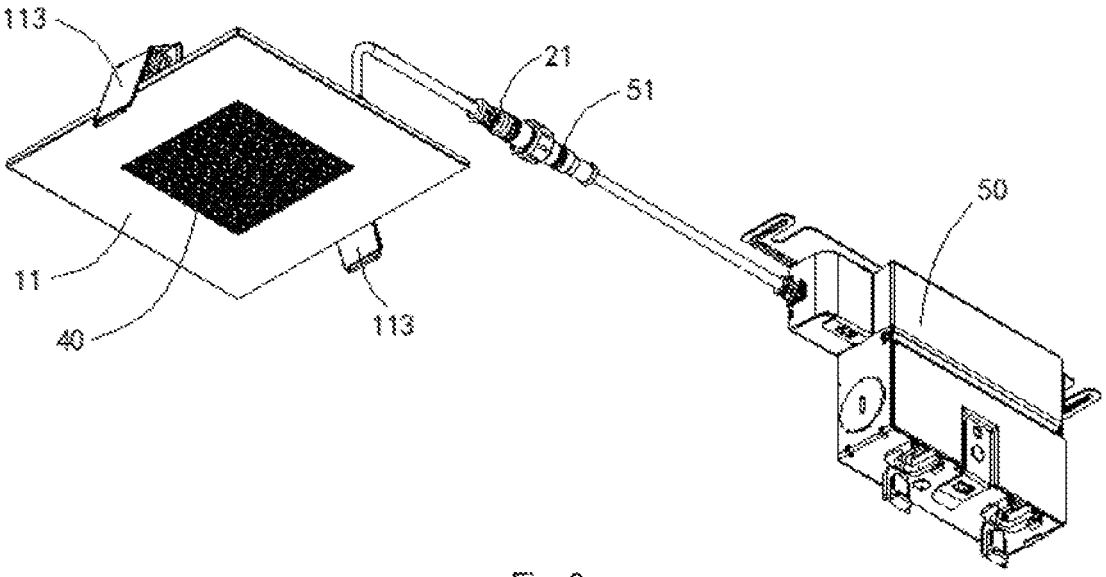
FIG. 3 illustrates another view of the example in FIG. 2.

Please refer to FIG. 3. FIG. 3 shows another view of the example in FIG. 2. In addition to the components shown in FIG. 2, FIG. 3 further shows a prism plate 40 exposed from a light opening of the surface rim 11.

Figure 4:
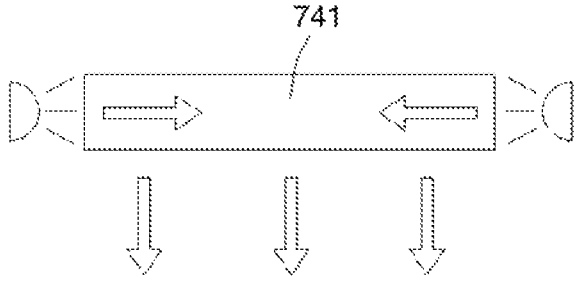
FIG. 4 illustrates a light guide example.

Please refer to FIG. 4, which shows a first option by using a light guide plate 741 where lights enter the light guide plate 741 from a lateral side and escape from a main surface of the light guide plate.

Figure 5:
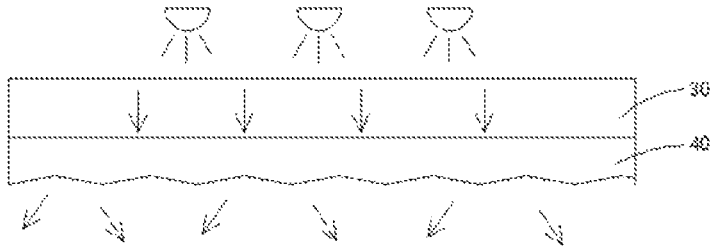
FIG. 5 illustrates another optical guiding example.

Please refer to FIG. 5. In FIG. 5, the light from the LED modules pass through a light passing cover 30 and then diffused by the prism plate 40.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light source module comprising a light source plate and multiple LED modules mounted on the light source plate;

a light passing cover with a first side facing to the multiple LED modules for receiving a light from the multiple LED modules;

a prism plate disposed with more than 50 prism units for diffusing the light passing through the light passing cover from a second side of the light passing cover;

a surface rim having a light opening for the light diffused by the prism units to escape from the lighting apparatus, wherein the light passing cover is a glue layer, wherein the glue layer contains fluorescent material, wherein the surface rim has a side wall for enclosing and placing the prism plate; and a back cover to fix to the side wall of the surface rim, wherein the side wall has a pair of protruding arms to be inserted through corresponding plug holes of the back cover.

2. The lighting apparatus of claim 1, further comprising a bracket for fixing keeping the multiple LED modules with a predetermined distance to the light passing cover.

3. The lighting apparatus of claim 1, wherein the bracket has a side wall with a first edge fixing to the light source module and with a second edge fixing to the light passing cover.

4. The lighting apparatus of claim 1, wherein the prism plate has a positioning groove for inserting the light passing cover.

5. The lighting apparatus of claim 1, wherein each protruding arm is attached with an elastic unit for fixing to an installation platform.

6. The lighting apparatus of claim 1, wherein the light source module is disposed on the back cover.

7. The lighting apparatus of claim 1, wherein the back cover comprises metal material for heat dissipation.

8. The lighting apparatus of claim 1, wherein the surface rim comprises metal material for heat dissipation.

9. The lighting apparatus of claim 1, wherein the back cover is a circular shape and the surface rim has a rectangular shape.

10. The lighting apparatus of claim 1, wherein the prism units in central positions have larger diameters than the prism units in peripheral positions.

11. The lighting apparatus of claim 1, wherein the prism units are arranged on a three-dimension curve convex surface.

12. The lighting apparatus of claim 1, wherein the light passing cover has diffusion lenses corresponding to the LED modules.

13. The lighting apparatus of claim 1, wherein the light passing cover is a flat plastic plate.

14. The lighting apparatus of claim 1, wherein there is an anti-blue-light layer disposed between the light passing cover and the prism plate layer.

* * * * *